United States Patent [19]

Hirano et al.

[11] Patent Number: 5,015,199

[45] Date of Patent: May 14, 1991

[54] ELECTRIC CONNECTOR

[75] Inventors: Seiji Hirano, Hiroshima; Masaharu Sakaguchi, Shizuoka; Satoru Kawanishi, Shizuoka; Tomoyuki Ohmura, Shizuoka, all of Japan

[73] Assignee: Yazaki Corporation, Tokyo, Japan

[21] Appl. No.: 425,901

[22] Filed: Oct. 24, 1989

[30] Foreign Application Priority Data

Oct. 28, 1988 [JP] Japan ..... 63-139989[U]

[51] Int. Cl.[5] ..... H01R 13/627

[52] U.S. Cl. ..... 439/353; 439/357

[58] Field of Search ..... 439/345, 350, 351, 352, 439/353, 354, 355, 356, 357, 595

[56] References Cited

U.S. PATENT DOCUMENTS

| | | | |
|---|---|---|---|
| 3,409,858 | 11/1968 | Krehbiel | 439/354 |
| 4,583,805 | 4/1986 | Mantlik . | |
| 4,660,915 | 4/1987 | Mantlik . | |
| 4,708,662 | 11/1987 | Klein | 439/353 |
| 4,787,864 | 11/1988 | Hunt, III et al. | 439/595 |
| 4,884,978 | 12/1989 | Inaba et al. | 439/352 |

FOREIGN PATENT DOCUMENTS

| | | | |
|---|---|---|---|
| 2159345 | 11/1985 | United Kingdom | 439/350 |

*Primary Examiner*—Neil Abrams
*Assistant Examiner*—Khiem Nguyen
*Attorney, Agent, or Firm*—Armstrong, Nikaido, Marmelstein, Kubovcik & Murray

[57] ABSTRACT

An electric connector which can prevent soiling to terminals thereof without the necessity of provision of an additional part such as a cap. The electric connector comprises a pair of female and male housings formed for fitting engagement with each other in one direction, a locking arm extending from the male housing in parallel to and resiliently displaceable in a direction perpendicular to the fitting direction, and a first engaging projection formed on the locking arm for fitting in an opening formed in the female housing. A first arresting element is provided on the female housing for engaging with the first engaging projection in a fully fitted position of the female and male housings to lock the housings in the position. A second engaging projection is provided at a location on the male housing forwardly of the first engaging projection, and a second arresting element is provided on the female housing for engaging with the second engaging projection in a half-fitted position of the female and male housings to temporarily lock the housings in the position.

13 Claims, 4 Drawing Sheets

ELECTRIC CONNECTOR

BACKGROUND OF THE INVENTION

1. Field of the Invention

This invention relates to an electric connector wherein a double-locking mechanism is provided between a pair of female and male housings adapted to fit with each other.

2. Description of the Prior Art

Various electric connectors used for branching of electric wires are conventionally known. An exemplary one of such conventional electric connectors is shown in FIG. 10.

Referring to FIG. 10, the electric connector shown includes a male housing M having a plurality of terminal receiving chambers a formed therein, and a female terminal c to which an electric wire b is connected is fitted in each of the terminal receiving chambers a. The electric connector further includes a female housing F to which a plurality of branch terminals e each having a plurality of male terminal contacting elements d formed thereon are secured by force fitting. The female and male housings F and M are fitted with each other to establish a branching connection of the branching terminals e to the plurality of electric wires b.

Since such male housing F is normally delivered to the user side in a condition wherein the branching terminals e are secured by force fitting therein, such branching terminals e are likely to be touched by a hand or soiled by oil or dust during storage or transportation or upon fitting thereof with the male housing M. Consequently, there is the possibility that the branching terminals e may not sufficiently be contacted with the male terminals c, which will cause incomplete electric connection between them. Such a situation must not take place in an electric wiring system of an air bag device of an automobile because it may affect a human life.

One of available countermeasures is to cover the female housing F with a cap made of a plastic or the like. The countermeasure, however, is not preferable because it requires such an additional part and an involved rise of cost and further requires time for mounting of the cap.

SUMMARY OF THE INVENTION

It is an object of the present invention to provide an electric connector which can prevent soiling to terminals thereof without the necessity of provision of an additional part such as a cap.

In order to attain the object, according to the present invention, there is provided an electric connector which comprises a pair of female and male housings formed for fitting engagement with each other in one direction, a first locking arm provided on an outer wall of the male housing by way of a base portion and extending in parallel to the fitting direction, the first locking arm being capable of resiliently displaced in a direction perpendicular to the fitting direction, a first engaging projection formed on the first locking arm, the female housing having a casing portion for receiving the male housing therein, the casing portion having an opening through which a disengaging action is accessible to the first locking arm, a first arresting element provided on the casing portion for engaging with the first engaging projection in a fully fitted position of the female and male housings to lock the female and male housings to each other in the fully fitted position, a second engaging projection formed at a location on the male housing forwardly of the first engaging projection, and a second arresting element provided on the casing portion of the female housing for engaging with the second engaging projection in a half-fitted position of the female and male housings to temporarily lock the female and male housings to each other in the half-fitted position.

With the electric connector, the female and male housings can be locked not only at a fully fitted position due to engagement between the first arresting element and the first engaging projection thereon, respectively, but also at a half-fitted position due to engagement between the second arresting element and the second engaging projection thereon, respectively. Since the female and male housings can be locked at the half-fitted position in this manner, when terminals assembled in position to one of the female and male housings in advance are handled, possible sticking of dust or the like to the terminals can be prevented, which assures a stabilized connecting condition of the terminals to companion terminals. Besides, the operability in assembly of the electric connector is high.

The above and other objects, features and advantages of the present invention will become apparent from the following description and the appended claims, taken in conjunction with the accompanying drawings in which like or corresponding parts are denoted by like reference characters through all of the figures.

DETAILED DESCRIPTION OF THE PREFERRED EMBODIMENT

Figure 1:
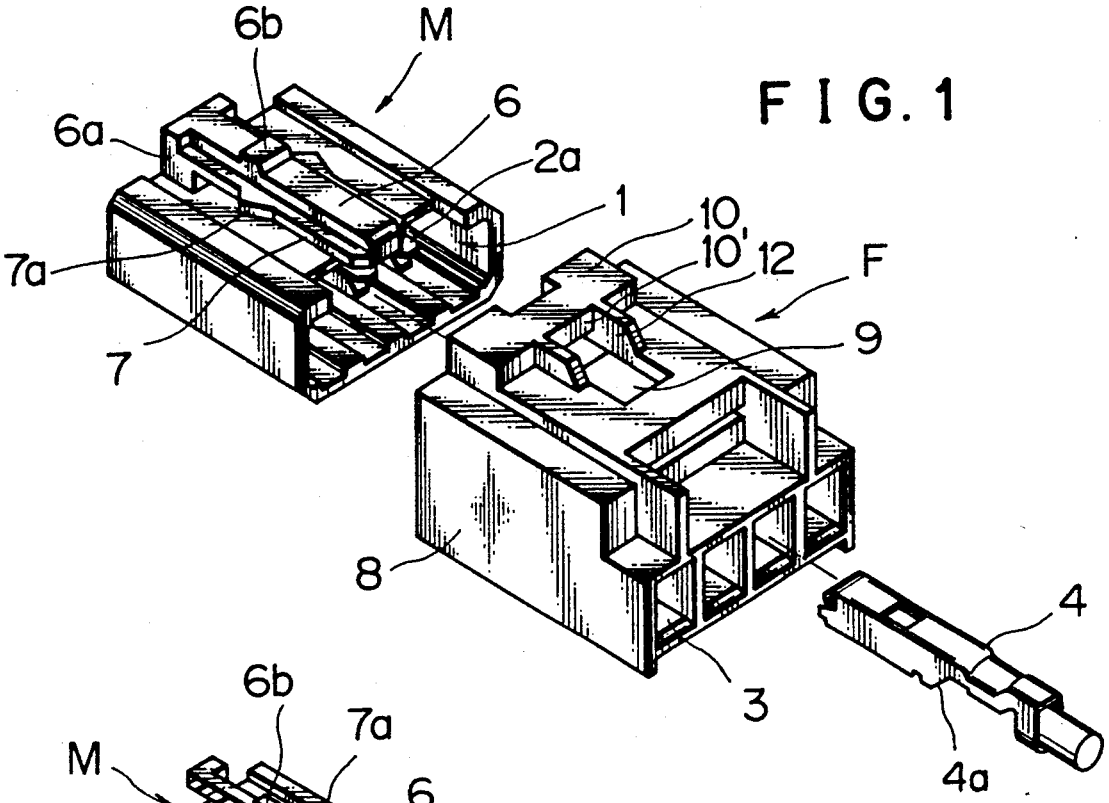
FIG. 1 is a perspective view of female and male housings of an electric connector in a disassembled condition showing an embodiment of the present invention.
Figure 2:
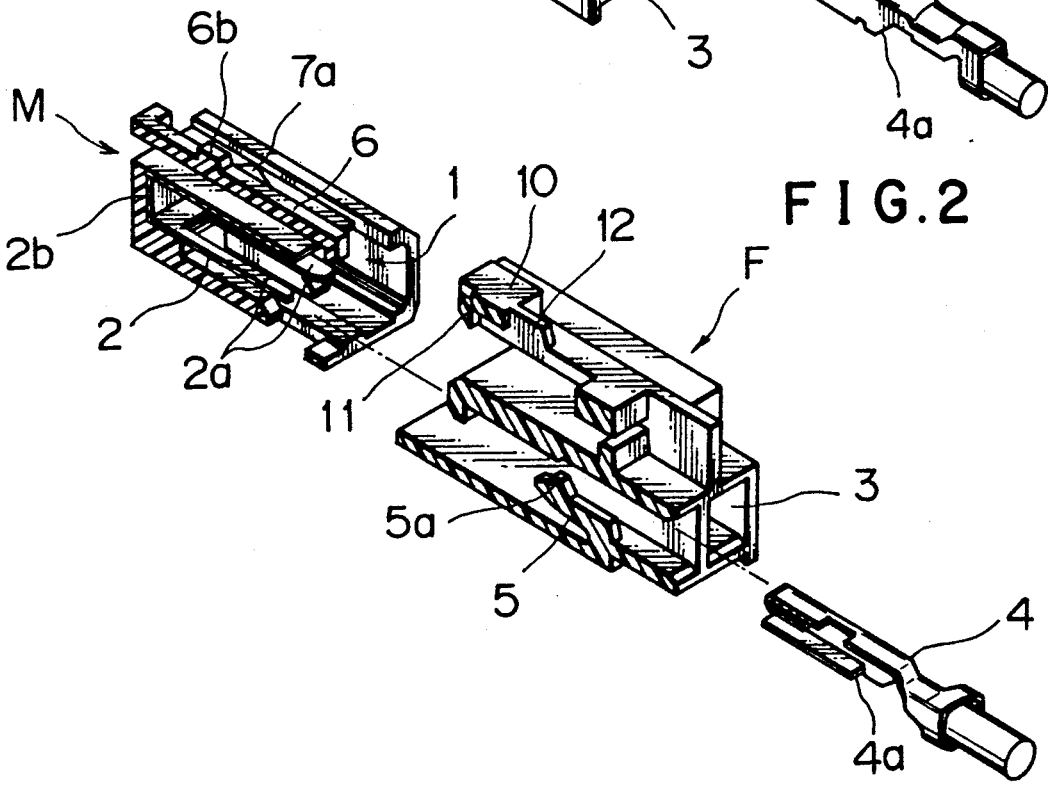
FIG. 2 is perspective, vertical sectional view of the female and male housings of FIG. 1 taken along an axial center line of the electric connector.
Figure 4:
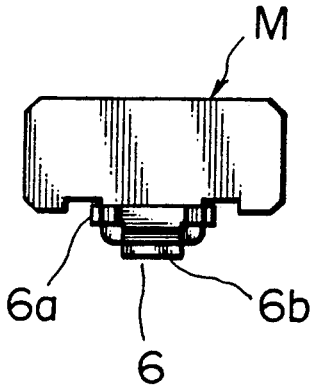
FIG. 4 is a front elevational view of the male housing shown in FIG. 1.

Referring to FIGS. 1 to 7, there is shown an electric connector to which the present invention is applied. The electric connector shown includes a male housing M having a terminal receiving chamber 1 formed therein. A branch terminal 2 having a plurality of male terminal contacting elements 2*a* formed in a branching manner thereon is secured at a base portion 2*b* thereof in the terminal receiving chamber 1 of the male housing M by force fitting. The electric connector further includes a female housing F having a plurality of terminal receiving chambers 3 formed therein. A female terminal 4 is received in each of the terminal receiving chambers 3 of the female housing F. Each of the female terminals 4 has an arresting hole 4a formed therein while a flexible arresting arm 5 is formed in an integral relationship on an inner wall of each of the terminal receiving chambers 3 of the female housing F. A projection 5a is formed on each of the flexible arresting arms 5 and engaged in the arresting hole 4a of the corresponding female terminal 4 to prevent coming off of the female terminal 4 from the female housing F.

A first locking arm 6 and a pair of second locking arms 7 are provided on an outer wall of an upper portion of the male housing M.

The first locking arm 6 extends upwardly at a rear base portion 6a thereof and then forwardly in a fitting direction of the male housing M toward the female housing F such that a forward end thereof may be displaced resiliently in an up and down direction with respect to the base portion 6a thereof. The first locking arm 6 has an engaging projection 6b formed on an upper face thereof.

The second locking arms 7 are supported at the opposite ends thereof on the upwardly extending base portion 6a and a forward end portion of the first locking arm 6 and extend on the opposite sides of and below the first locking arm 6. A second engaging projection 7a is provided projectingly on an outer side of each of the second locking arms 7.

The second locking arms 7 are thus constructed for resilient displacement in directions perpendicular to the forward and rearward fitting direction in a spacing between the first locking arm 6 and the outer wall of the male housing M. The second engaging projections 7a are provided at locations forwardly of the engaging projection 6b.

Meanwhile, a casing portion 8 of the female housing F has, on the upper wall at the rear end, a mound 10 in which the first locking arm 6 and the like protruding upwardly from the upper wall of the male housing M is to be received. The upper wall of the casing portion in the female housing F has an opening 9 adjacent the front face of the mound 10 to provide a shoulder 10' for engaging with and arresting the engaging projection 6b of the first locking arm 6 in a fully fitted condition of the female and male housings F and M.

A pair of protective walls 12 which are provided uprightly on the opposite sides of the opening 9 of the casing portion 8 is cooperated with the mound 1 to prevent the engaging projection 6b of the first locking arm 6 from being touched and pushed by an external foreign member.

A pair of second arresting portions 11 for engaging with the second projections 7a of the second locking arms 7 are provided projectingly on and extend inwardly from a pair of opposing inner faces of the casing portion 8 on the lower side of the arresting portion 10. The second engaging projections 7a are preferably of a shape having a front and a rear gentle slopes for easy engagement and disengagement, while the first engaging projection 6b has a vertical face rearwardly for firm and exact engagement and its disengagement is made by a pushing member through the opening 9.

Figure 5:
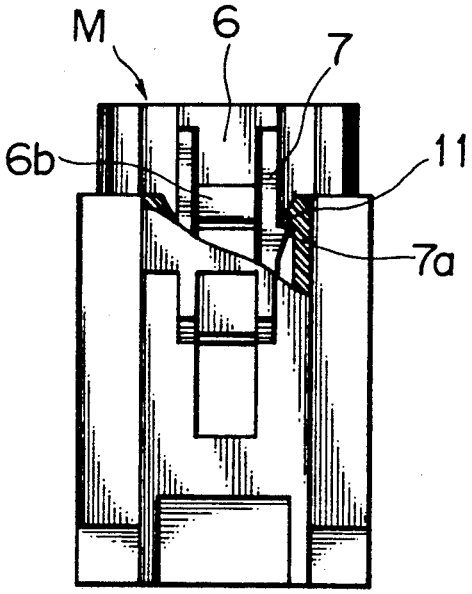
FIG. 5 is a top plan view, partly in section, showing a half-fitted condition of the female and male housings of the electric connector of FIG. 1.
Figure 3:
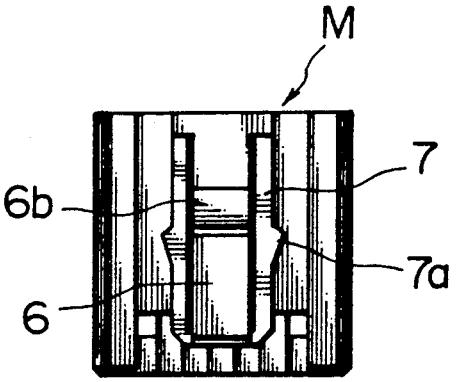
FIG. 3 is a top plan view of the male housing shown in FIG. 1.
Figure 10:
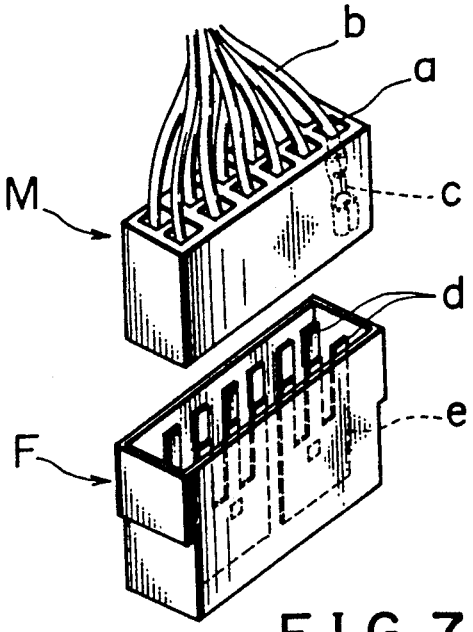
FIG. 10 is a perspective view of female and male housings of an exemplary conventional electric connector in a disassembled condition.
Figure 6:
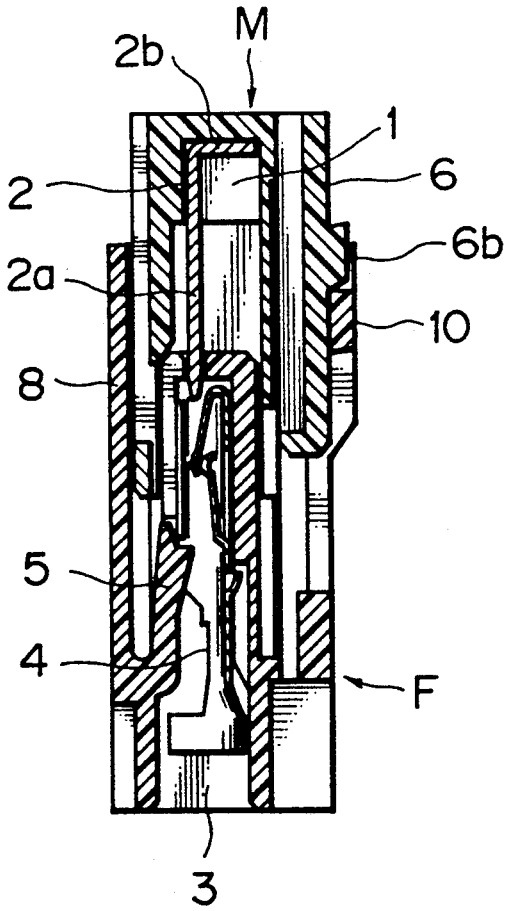
FIG. 6 is an enlarged vertical sectional view showing the female and male housings in the condition shown in FIG. 5.

When the male housing M is fitted halfway into the casing portion 8 of the female housing F as shown in FIGS. 5 and 6, the engaging projection 6b of the first locking arm 6 is brought into contact with a front face of the arresting portion 10 of the female housing F. Simultaneously, the second projections 7a of the second locking arms 7 are engaged with the second arresting portions 11 of the female housing F.

Consequently, the female and male housings F and M are temporarily locked to each other in their half-fitted position. In the position, front ends of the male terminal contact element 2a of the branching terminal 2 come to the female terminals 4 into a condition just before connection thereof.

When the male housing M is further pushed to advance into the female housing F, the first locking arm 6 is advanced while being deformed downwardly due to contacting engagement of the engaging projection 6b thereof with the arresting portion 10 of the female housing F.

Figure 7:
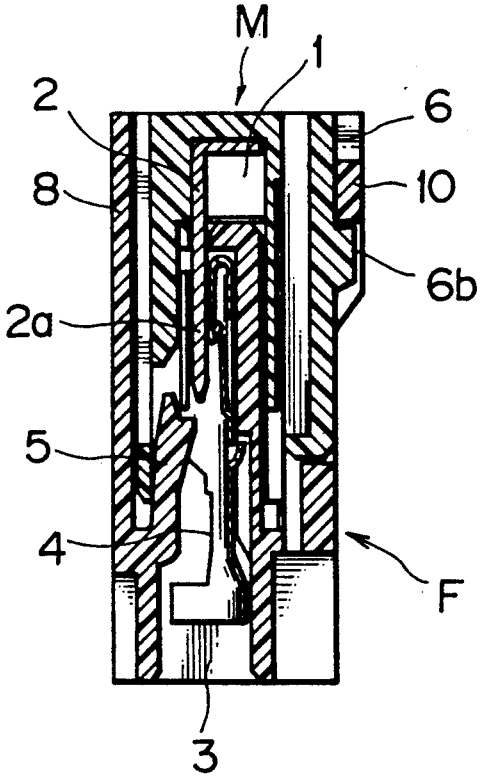
FIG. 7 is a similar view but showing a fully fitted condition of the female and male housings of the electric connector of FIG. 1.

When the female and male housings F and M are fitted completely with each other as shown in FIG. 7, the engaging projection 6b of the first locking arm 6 is released from the arresting portion 10 of the female housing F to allow the first locking arm 6 to be returned to its normal condition by the resiliency thereof so that the engaging projection 6b is projected into the opening 9 while a rear face of the engaging projection 6b is contacted with the arresting portion 10. Consequently, the male housing M is locked fully to the female housing F. Simultaneously, connection between the branching terminal 2 and the male terminals 4 is also achieved.

In this manner, the female and male housings F and M are temporarily locked to each other in their half-fitted condition before full connection between the branching terminal 2 and the female terminals 6 is established.

Accordingly, a connector maker can deliver to a user an electric connector in a condition wherein the female housing F is temporarily locked to the male housing M in which the branching terminal 2 is fitted.

Thus, the user may fully lock the female and male housings F and M to each other after females 4 required for wiring and/or assembly of the electric connector to an electric appliance are inserted into the female housing F. Accordingly, there is no possibility that the branch terminal 2 may be touched by a hand or soiled by dust or the like during such operation.

In the embodiment as shown in FIG. 1 to 7, the first and second engagement projections are provided in locking arms each independently deformable. So the disengagement action of the first engagement projection does not cause an unintentional disengagement of the second engagement projections.

Further the direction of deforming the locking arms is different between the first and second locking arms, the first one in a vertical direction and the second ones in a horizontal direction. This arrangement does not serve only for achieving compact construction of the connector due to common use of space allowing deformation of locking arms, but also the pushing-down of the first locking arm for disengagement prevents the second locking arms from an unintentional deformation leading to disengagement.

While the electric connector of the present embodiment has such a construction as described above, it may be modified in various manners. For example, while the first and second engaging projections 6b and 7a are provided on the first and second locking arms 6 and 7 for engaging with the first and second arresting portions 10 and 11 to lock the female and male housings F and M at the fully fitted position and the half-fitted position, respectively, they may otherwise be disposed in a different positional relationship to the first and second locking arms 6 and 7 and/or to the first and second arresting portions 10 and 11 such that they may serve to lock the female and male housings F and M reversely at the half-fitted position and the fully fitted position, respectively.

Figure 8:
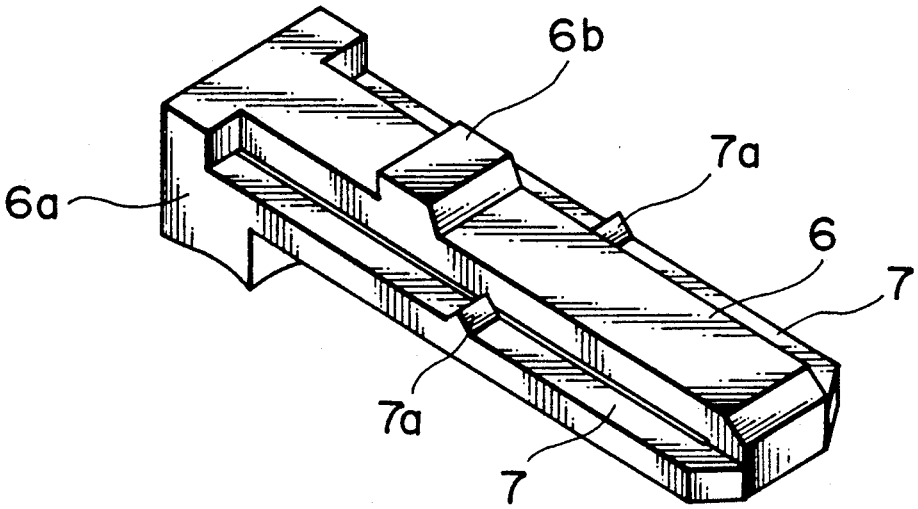
FIG. 8 is a perspective view of part of a modified male member.

Further, while in the embodiment described above each of the second locking arms 7 on which the second engaging projections *7a* are formed can be deformed or displaced resiliently at the free end thereof in a direction perpendicular to the direction in which the first locking arm 6 on which the first engaging projection *6b* is provided can be deformed or displaced at the free end thereof, the first and second locking arms 6 and 7 may be constructed otherwise such that they may be deformed or displaced in the same direction. FIG. 8 shows such a modified arrangement of the first and second locking arms 6 and 7. Referring to FIG. 8, the modified arrangement is generally similar to the corresponding arrangement shown in FIGS. 1 to 7 but is different in that the second engaging projection *7a* is provided not on an outer face but on an upper face of each of the second locking arms 7. Meanwhile, though not particularly shown, the second arresting portions 11 for engaging with the second engaging projections *7a* of the second locking arms 7 are provided on lower or inner face portions of the casing portion 8 of the female housing F. Accordingly, when the male housing M is inserted to a predetermined half-fitted position into the female housing F, the second engaging projections *7a* are engaged with the second arresting portions 11 so that the second locking arms 7 are resiliently deformed downwardly by the latter. The female and male housings F and M are thus locked at the half-fitted position defined by the engagement between the second arresting portions 11 and the second engaging portions *7a*. When the male housing M is thereafter inserted to a fully fitted position into the female housing F, the first locking arm 6 is deformed or displaced also downwardly due to engagement of the first engaging projection *6b* thereon with the first arresting portion 10 on the female housing F as described hereinabove.

Also with the modified arrangement, similar effects can be attained to those of the arrangement shown in FIGS. 1 to 7.

Figure 9:
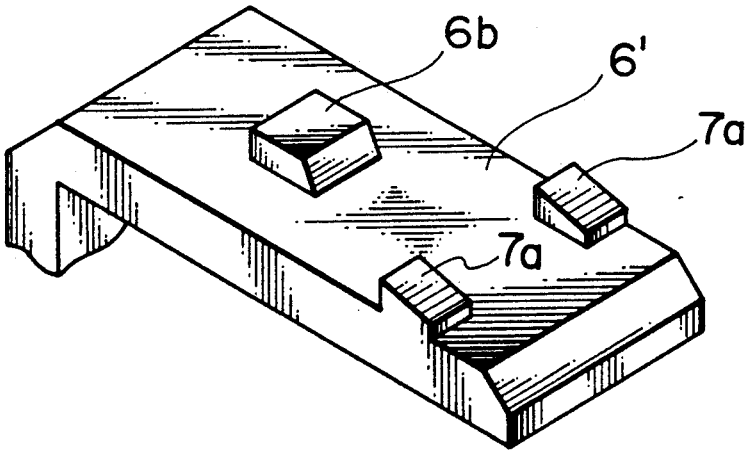
FIG. 9 is a perspective view of part of another modified male member.

While in the arrangements shown in FIGS. 1 to 7 and in FIG. 8 the first and second engaging projections *6b* and *7a* are provided on different members, that is, the first and second locking arms 6 and 7, respectively, they may otherwise be provided on a single locking arm. Such alternative is shown in FIG. 9. In particular, in the arrangement shown in FIG. 9, the first and second engaging projections *6b* and *7a* are provided on an upper face of a single locking arm generally denoted at 6'. Here, the single locking arm 6' may be generally regarded as the first locking arm 6 of the arrangement shown in FIG. 8 on which the second locking arms 7 are formed in an integral relationship. The locking arm 6' is thus deformed downwardly when the first engaging projection *6b* thereon is engaged with the first arresting portion 10 of the female housing F and also when the second engaging projections *7a* thereon are engaged with the corresponding second arresting shoulders or projections 11.

Having now fully described the invention, it will be apparent to one of ordinary skill in the art that many changes and modifications can be made thereto without departing from the spirit and scope of the invention as set forth herein.

What is claimed is:

1. An electric connector, comprising a pair of female and male housings formed for fitting engagement with each other in one direction, the housings having terminals that electrically engage each other as the housing are mated, a locking arm means provided on an outer wall of said male housing by way of a base portion and extending in parallel to the fitting direction, said locking arm means being capable of resiliently deformed in a direction perpendicular to the fitting direction, a first engaging means formed on said locking arm means said female housing having a casing portion for receiving said male housing therein, said casing portion having an opening through which a disengaging action is accessible to said locking arm means, a first arresting means provided on said casing portion for engaging with said first engaging means in a fully fitted position of said female and male housings to lock said female and male housings to each other in the fully fitted position, a second engaging means formed at a location on said locking arm means forwardly of said first engaging means, and a second arresting means provided on said casing portion of said female housing for engaging with said second engaging means in a half-fitted position of said female and male housings to temporarily lock said female and male housings to each other in the half-fitted position.

2. An electric connector as claimed in claim 1, wherein said base portion by way of which said locking arm means is provided on said outer wall of said male housing is an upwardly extending base portion.

3. An electric connector as claimed in claim 1 or 2, wherein said locking arm means is capable of being resiliently deformed in an up and down direction, and said first engaging means is provided on an upper face of said locking arm means.

4. An electric connector as claimed in any one of claims 1 or 2, wherein said locking arm means consists of a first locking arm and a second locking arm, said second locking arm is provided on at least one side of said first locking arm between said first locking arm and said outer wall of said male housing for being resiliently deformed in a direction perpendicular to the fitting direction, and said second engaging means is provided on said second locking arm.

5. An electric connector as claimed in claim 4, wherein said second locking arm is capable of being resiliently deformed in a direction perpendicular to the direction in which said first locking arm is capable of being resiliently deformed.

6. An electric connector as claimed in claim 1 or 2, wherein said locking arm means consists of a first locking arm and a second locking arm, said second locking arm being provided in a juxtaposed relationship to said first locking arm such that they may be capable of being resiliently deformed in the same direction.

7. An electric connector as claimed in claim 3, wherein said locking arm means consists of a first locking arm and a second locking arm, said locking arm being provided in a juxtaposed relationship to said first locking arm such that they may be capable of being resiliently deformed in the same direction.

8. An electric connector assembly comprising:

at least two members including a first member having an arm support portion and a second member having a casing portion adapted for fitting engagement with said first member in one direction, the members having terminals that electrically engage each other as the members are mated;

locking arm means provided on said arm support portion of said first member to extend in parallel to said one direction, said locking arm means including a base portion erected on an outer wall of said first member, a first locking arm (6) extending from said base portion in a plane extending parallel to said support portion and a second locking arm (7) extending on a first lateral side of said first locking arm to define a space in cooperation with said support portion of said first member, said space allowing resilient deformation of said first locking arm and said second locking arm thereinto;

first engaging means (*6b*) formed on said first locking arm;

first arresting means (10) provided on said casing portion for engagement with said first engaging means (*6b*) in a fully fitted position of said first and second members to lock said first and second members to each other in the fully fitted position;

second engaging means (*7a*) formed on said second locking arm (7) forwardly of said first engaging means;

second arresting means (11) provided on said casing portion of said female housing forwardly of said first arresting means (10) for engaging with said second engaging means (*7a*) in a half-fitted position of said first and second members to temporarily lock said first and second member to each other in the half-fitted position.

9. An electric connector assembly according to claim 8, wherein said first member includes a male housing and said second member includes a female housing.

10. An electric connector assembly according to claim 9, wherein said casing portion of said female housing has an opening through which a disengaging action is accessible to said first locking arm.

11. An electric connector assembly according to claim 8, wherein said second locking arm extends in a perpendicular plane to said support portion of said first member.

12. An electric connector assembly according to claim 8, wherein said second locking arm extends substantially parallel to said support portion.

13. An electric connector assembly according to claim 11 or 12, further including a third locking arm on a second lateral side of said first locking arm.

* * * * *